US005144809A

United States Patent [19]

Chevalier et al.

[11] Patent Number: 5,144,809

[45] Date of Patent: Sep. 8, 1992

[54] APPARATUS FOR PRODUCTION OF NITROGEN

[75] Inventors: Gilbert Chevalier, Guyancourt; Christiane Muller, Jouy en Josas; Frédéric Rousseau, Paris; Laurent Savinel, Toul; Jean-Yves Thonnelier, Voisins le Bretonneux, all of France

[73] Assignee: L'Air Liquide, Societe Anonyme pour l'Etude et l'Exploitation des Procedes Georges Claude, Paris, France

[21] Appl. No.: 739,686

[22] Filed: Aug. 2, 1991

[30] Foreign Application Priority Data

Aug. 7, 1990 [FR] France ..... 90 10077

[51] Int. Cl.[5] ..... F25J 3/00

[52] U.S. Cl. ..... 62/36; 62/42; 165/166

[58] Field of Search ..... 62/36, 42; 165/166

[56] References Cited

U.S. PATENT DOCUMENTS

| | | | |
|---|---|---|---|
| 3,282,334 | 11/1966 | Stahlheber | 62/36 |
| 3,568,462 | 3/1971 | Hoffman et al. | 62/42 |
| 3,992,168 | 11/1976 | Toyama et al. | 62/42 |
| 4,574,007 | 3/1986 | Yearout et al. | 62/42 |
| 4,599,097 | 7/1986 | Petit et al. | 62/36 |
| 4,606,745 | 8/1986 | Fujita | 165/166 |
| 4,699,209 | 10/1987 | Thorogood | 165/166 |
| 4,715,431 | 12/1987 | Schwartz | 62/36 |
| 4,715,433 | 12/1987 | Schwartz | 62/36 |
| 4,717,410 | 1/1988 | Grenier | 62/29 |

FOREIGN PATENT DOCUMENTS

| | | |
|---|---|---|
| 1444458 | 11/1968 | Fed. Rep. of Germany . |
| 1491584 | 7/1967 | France . |
| 2210570 | 7/1974 | France . |

*Primary Examiner*—Ronald C. Capossela
*Attorney, Agent, or Firm*—Curtis, Morris & Safford

[57] ABSTRACT

The apparatus comprises a heat exchange line, a fractionating column which is cooled by means of a rich liquid and a section for adiabatic enrichment with nitrogen derived from entering air, the whole being integrated into a parallelepipedal heat exchanger of the plates and blades type. Use for the production of nitrogen of average purity.

10 Claims, 4 Drawing Sheets

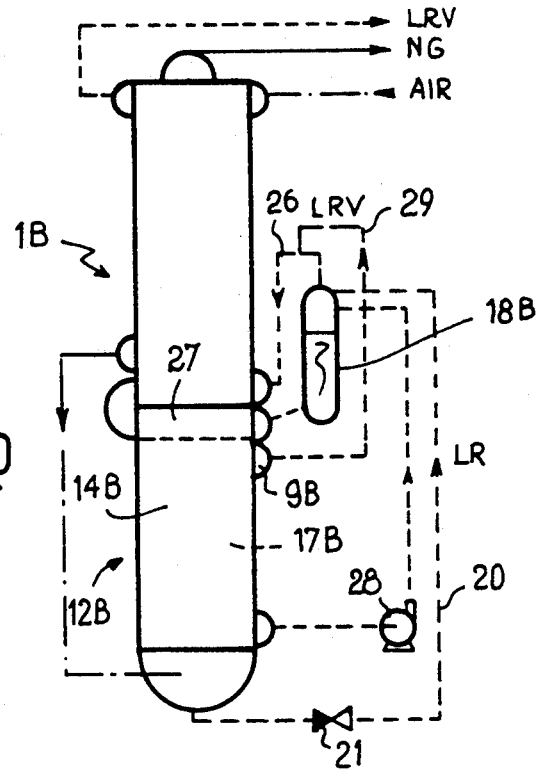
FIG.10
FIG.11
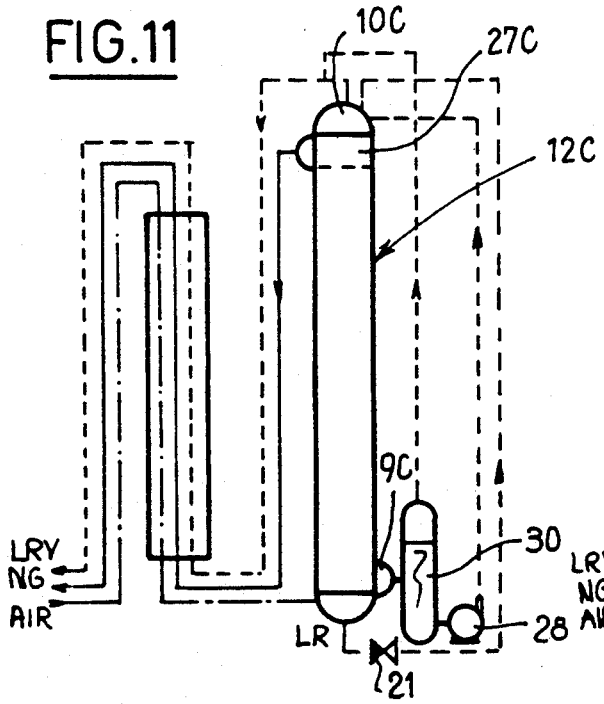
FIG.12
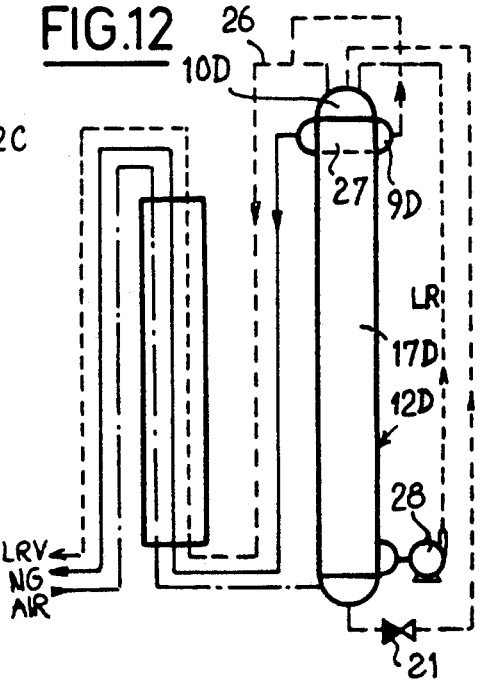

APPARATUS FOR PRODUCTION OF NITROGEN

BACKGROUND OF INVENTION

1. Field of the Invention

The present invention relates to an apparatus for the production of nitrogen, of the type comprising means for cooling compressed air from which water and carbon dioxide have been removed, rising means for progressively loading this air with nitrogen, and a condenser which is adapted for cooling the upper portion of these rising means by vaporization of rich liquid in order to produce a reflux therein. It applies more particularly to the production of nitrogen of average purity, i.e. typically between about 90 and 99%.

2. Description of Prior Art

The production of nitrogen is presently carried out by means of air distillation columns. If very pure nitrogen is not needed, one way would be to reduce the number of plates of the distillation column, however the economical benefit is low. With respect to the production by non cryogenic means (selective adsorption, selective permeation), it requires a large number of modules mounted in parallel, which is often unacceptable.

SUMMARY OF INVENTION

The invention aims at providing a very economical apparatus which is capable of producing nitrogen of average purity.

For this purpose, it is an object of the invention to provide an apparatus of the type mentioned above, characterized in that said rising means comprise first flat ducts of a heat exchanger of the type provided with plates and blades, and in that the condenser comprises second flat ducts of the same exchanger disposed in heat exchange relationship with at least the upper portion of the first ducts and connected via a duct provided with an expansion valve with a box for collecting a rich liquid, provided at the lower end of these first ducts.

According to other characteristics of the invention:

The means for cooling air, preferably disposed above the first and second ducts, comprise flat ducts of the heat exchanger located in the extension of these first and second ducts, namely third ducts supplied with entering air and disposed in heat exchange relationship on the one hand with fourth ducts connected to the upper ends of the first ducts, and on the other hand with fifth ducts connected to the upper ends of the second ducts;

the condenser comprises an auxiliary storage holder for rich liquid which is juxtaposed with the heat exchanger and whose lower and upper parts are respectively connected to the lower ends and upper ends of the second ducts;

according to another embodiment, the condenser is of the type operating by streaming of rich liquid and with a pump for rising the excess of non vaporized rich liquid at the top of the condenser; such a condenser may comprise an auxiliary storage holder which is juxtaposed with the heat exchanger, ensuring the supply of rich liquid to the condenser and being supplied on the one hand by said duct, and on the other hand by means of the pump; this condenser may possibly comprise a two stage liquid distributor disposed at the upper ends of the two ducts;

the second ducts extend along the entire height of the first ducts or, as a variant, they may extend only along a portion of the height of the first ducts and downwardly by means of spaces which are closed at their lower end or, on the contrary, which communicate by means of this end with the first ducts.

Embodiments of the invention will now be described with reference to the annexed drawings, in which:

FIGS. 8 to 12 are views similar to FIG. 1, of various variants.

DESCRIPTION OF PREFERRED EMBODIMENTS

Figure 1:
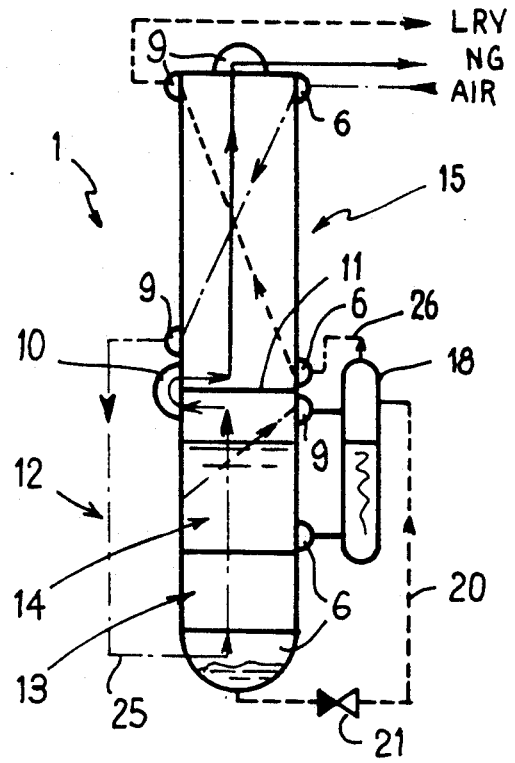
FIG. 1 is a schematic representation of an apparatus for the production of nitrogen according to the invention.
Figure 2:
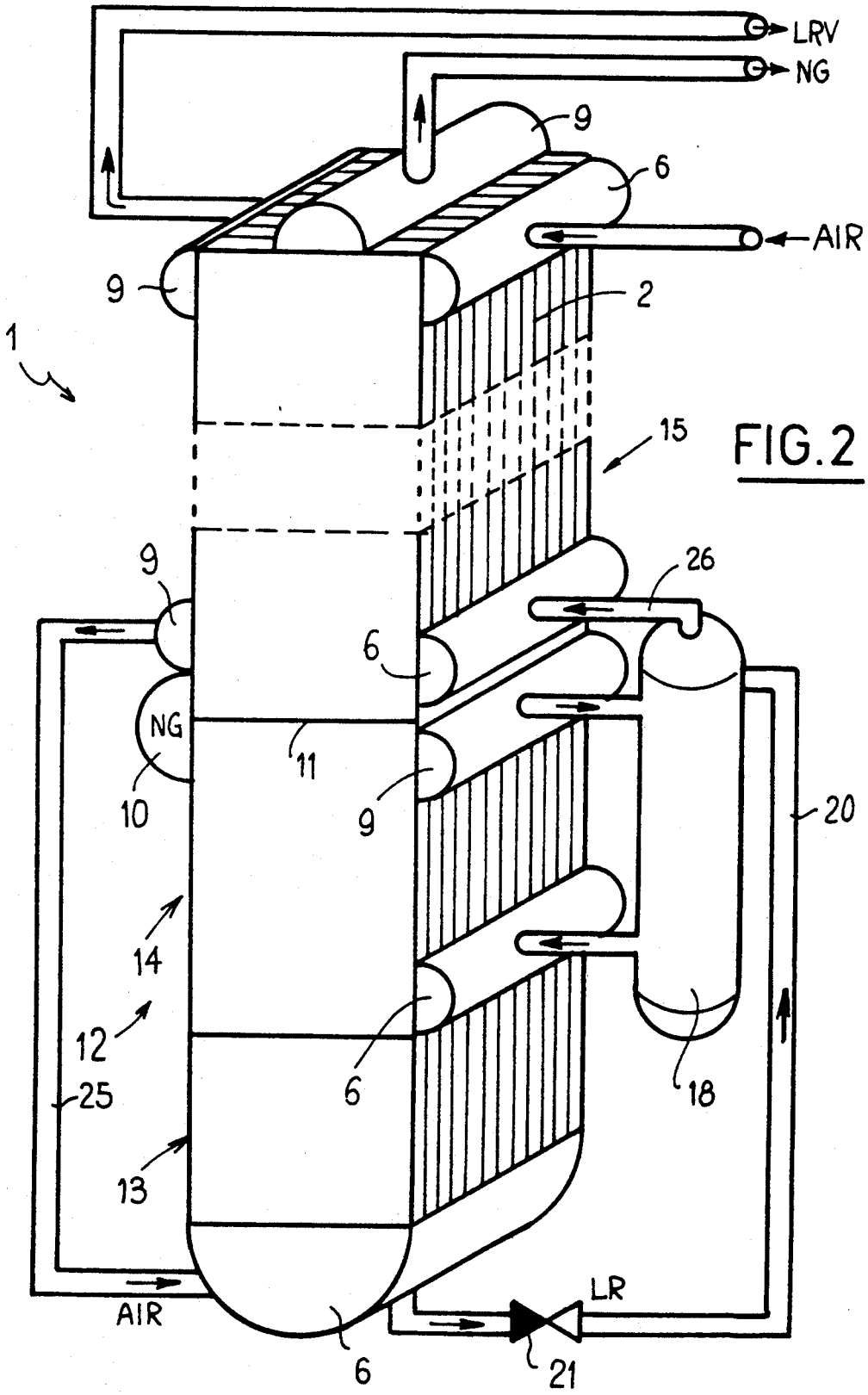
FIG. 2 is a perspective view of this apparatus.
Figure 3:
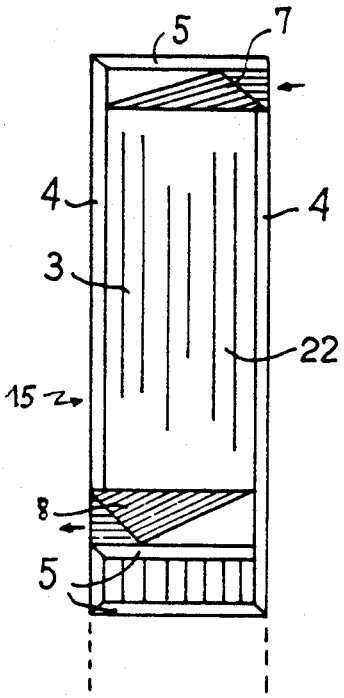
FIGS. 3 to 7 are longitudinal cross-section views taken through different ducts of the apparatus of FIGS. 1 and 2.
Figure 4:
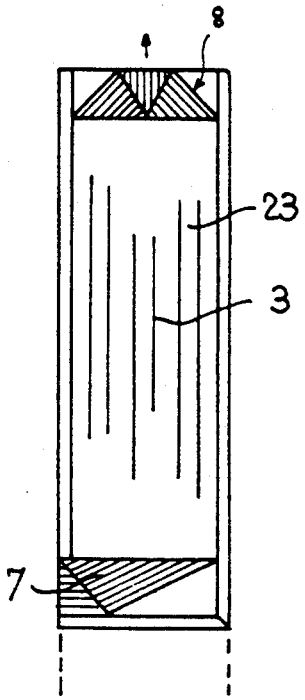
Figure 5:
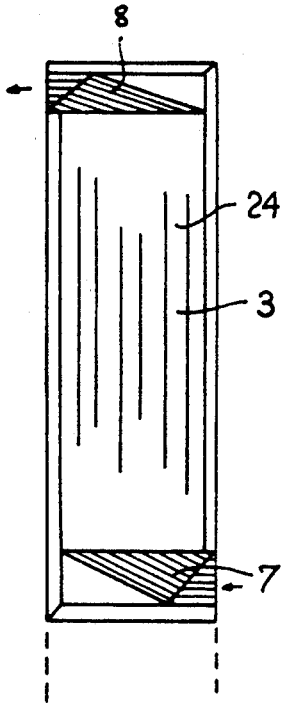

The apparatus for production of nitrogen represented in FIGS. 1 and 2, is intended to produce flows of the orders of 1,000 to 2,000 $Nm^3/h$ of nitrogen of about 95% purity. This apparatus essentially consists of a parallelepipedal heat exchanger 1 of the type including plates and blades of brazed aluminum. As is well known in the art, and as better seen on FIGS. 3 to 7, such an exchanger is formed of a large number of rectangular plates 2 of aluminum, which are vertical when in use, and piled over one another with aluminum wavy members 3 disposed therebetween constituting cross braces and vanes. Between these plates there are flat spaces containing the vanes. These spaces are bound laterally and in height by means of vertical and horizontal bars 4 and 5 disposed between the plates which correspond to the desired locations. Most of these spaces define ducts for the vertical circulation of fluids. To introduce a fluid at one end of a series of ducts, there is used a semi-cylindrical inlet box 6 fixedly mounted at the lower or upper end of the exchanger or laterally thereto and communicating with these ducts by means of spaces which remain opened between the corresponding plates 2. Distributors with oblique wavy members 7 of appropriate configuration enable to distribute along the entire width of the ducts, the fluids which are laterally introduced.

Similarly, distributors with oblique wavy members enable to evacuate a fluid either laterally (FIGS. 3 and 5 to 7), or vertically (FIG. 4), by means of a semi-cylindrical outlet box 9. As it will be seen later, the exchanger 1 also comprises a semi-cylindrical box 10 which is used for withdrawing a fluid from a series of ducts and, at the same time, for its introduction into another series of ducts.

To produce such an exchanger, the elements 2 to 5, 7 and 8 are positioned, the unit is assembled by brazing in a furnace, and the boxes 6, 9 and 10 are connected together by welding.

More particularly, the exchanger 1 consists of two superposed sections, which are sealingly separated by means of bars 5 schematically illustrated by full line 11 in FIGS. 1 and 2: a lower section 12 which itself is divided into a lower portion 13 for the adiabatic exchange of material and into an upper portion 14 forming a fractionating column, and an upper section 15 defining a line of heat exchange.

Section 12 consists of two series of ducts:

first ducts 16 (FIG. 6) extending substantially along the entire height of the section, supplied at the bottom and with lateral evacuation at their upper end; and second ducts 17 (FIG. 7) adjacent to the previous ones and extending substantially along the height of the portion 14, i.e. along a fraction only of the height of ducts 16 from the upper end of the latter. These ducts 17 have a lateral feed at their lower end and a lateral evacuation, on the same side, at their upper end. The corresponding boxes 6 and 9 (FIGS. 1 and 2) are respectively connected at the lower end and at the upper end of an auxiliary storage tank 18 located beside the exchanger 1, at the same level as portion 14 and slightly higher than the latter.

Spaces 19 (FIG. 7) downwardly extend each duct 17. They may either be closed at their lower end, as represented, or be downwardly opened and, in this case, they may communicate with ducts 16 for purposes of pressure equalization.

The upper part of the storage container 18 is connected at the bottom of box 6 for the inlet of the first ducts 16 by means of a duct 20 provided with an expansion valve 21.

The upper section 15 of the exchanger 1 comprises three series of ducts which extend along substantially its entire height:

third ducts 22 for cooling air (FIG. 3) having a lateral feed at their upper end and a lateral evacuation, on the other side, at their lower end;

fourth ducts 23 for warming nitrogen (FIG. 4) having a lateral feed at their lower end and a vertical evacuation, in middle position, at their upper end; and fifth ducts 24 for warming vaporized rich liquid (FIG. 5) having a lateral feed at their lower end and a lateral evacuation, on the opposite side, at their upper end.

In the Section 15, each duct 22 is sandwiched between a duct 23 and a duct 24, for heat exchange therebetween. Box 10 connects the outlet of the first ducts 16 to the inlet of the fourth ducts 23.

The apparatus thus described operates in the following manner:

The air to be treated, compressed at about 6 bars absolute and from which water and carbon dioxide have been removed, is introduced into the ducts 22 and exits therefrom at about its dewpoint. It thereafter passes, via a duct 25, into the lower box 6 of the exchanger 1, and from there into ducts 16.

The rich liquid (oxygen enriched air) collected in the lower box 6 is expanded in the expansion valve 21 and sent via duct 20 into the storage container 18. From there, the liquid phase passes into ducts 17 of portion 14. By heat exchange between ducts 16 and 17, some rich liquid is vaporized in ducts 17 and produces a reflux in ducts 16. There is thus produced in the latter, material exchanges, in an adiabatic fashion, in the lower portion 13, and in non adiabatic fashion, in the upper portion 14, and these exchanges of material lead to a progressive enrichment in nitrogen of the rising vapor. Finally, the product which exits from ducts 16 through box 10, and which from there, penetrates into ducts 23 to exit at about room temperature through upper box 9, consists of nitrogen of average purity.

The rich liquid which is vaporized in ducts 17 passes, by carrying some liquid, into storage container 18, and the vapor phase passes from the top of this storage container, via a duct 26, into ducts 24, to exit therefrom at about room temperature.

It will be seen that the portion 14 of the exchanger acts as a condenser and distillation column for the air to be treated and thus constitutes a fractionating column.

As a variant, portion 14 could extend along the entire height of the section 12, in which case, the total separation of the air would be carried out by means of a fractionating column.

The apparatus of FIGS. 1 to 7 is suitable for a nitrogen purity of the order of 90 to 95%. On the other hand, if a higher purity is desired, for example of the order of 98%, the height required, for section 12, would lead to a total height of the exchanger exceeding the possibilities of the present brazing furnaces, which permit at most the manufacture of exchangers of six meters long.

Figure 8:
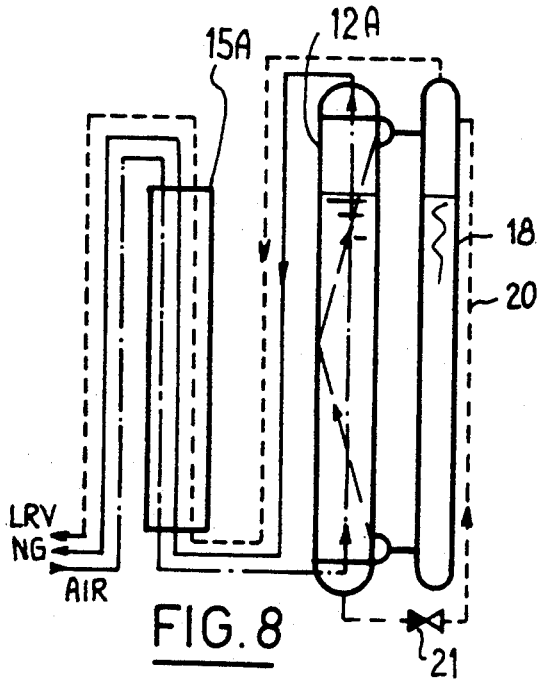
Figure 9:
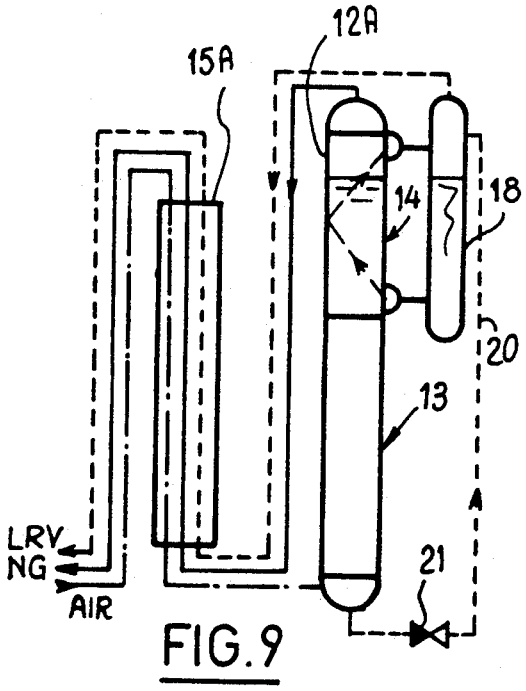

In this case, the variant of FIG. 8 or that of FIG. 9 must be used, these differing from the embodiment of FIGS. 1 to 7 by the fact that the heat exchange line consists of a distinct plate exchanger 15A connected by means of appropriate ducts to the main exchanger 12A corresponding to section 12 of FIGS. 1 to 7.

In the embodiment of FIG. 8, the storage holder of rich liquid 18 and the ducts of rich liquid 17 extend along the entire height of the ducts for the separation of air 16, while in that of FIG. 9, they extend only a fraction of their height, to the upper part of the exchanger 1A, for the reason explained above with respect to the embodiment of FIGS. 1 to 7.

FIG. 10 represents a variant of the apparatus of FIGS. 1 to 7 and differs therefrom only on two aspects: on the one hand, by the fact that the fractionating column 14B extends on the entire height of section 12B of the exchanger 1B, and on the other hand in the way in which the rich liquid is used in ducts 17B.

Indeed, in this case, the fractionating column is cooled by vaporization of rich liquid which streams down in the form of a thin film on the surfaces present in ducts 17B (plates and wavy members). For this purpose, there could be provided at the top of ducts 17B, a two-step distributor 27 of liquid according to what is described in EP-A-0 130 122 in the name of the Applicant. As described in that document, the distributor 27 can for example comprise a row of orifices for the predistribution of liquid in ducts 17B and along the entire length of the latter, these orifices opening on a lining for the fine distribution of liquid along the entire length of these same ducts, which lining is known under the name "serrated" and is arranged in a manner currently known as "hard-way".

The distributor 27 is supplied by simple gravity through the auxiliary storage container 18B, and a flow of rich liquid which is substantially double the flow which is vaporized in the ducts 17B streams down in the latter. The excess of rich liquid is sent up to the storage container 18B by means of a pump 28, so that this storage holder is supplied by this pump as well as by means of a duct 20.

Figure 6:
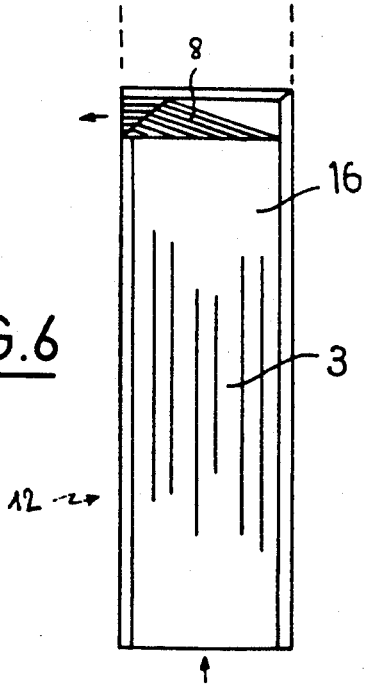
Figure 7:
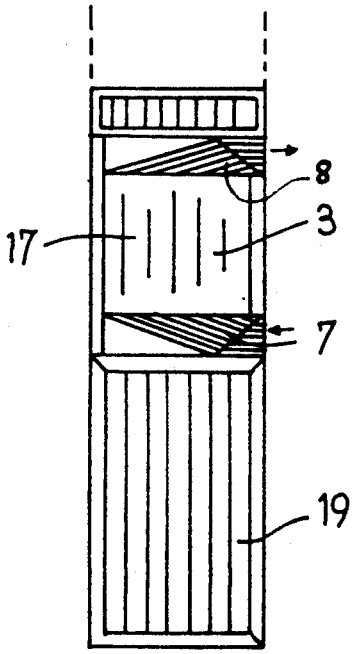

The schematic illustration of FIG. 10 corresponds to the utilization of a liquid distributor of the type illustrated in FIG. 6 of the EP-A mentioned above, namely designed so as to permit the evacuation of the rich liquid which is vaporized in ducts 17B through the upper portions of these ducts. This vaporized rich liquid is taken out of the exchanger via a lateral outlet box 9B and a duct 29 opening in duct 26.

FIGS. 11 and 12 show how a vaporization of enriched liquid by streaming down may be adapted to the embodiment, including two distinct exchangers, of FIG. 8.

FIG. 11 corresponds to the case where the distributor 27C of rich liquid does not permit the evacuation at the top, of the vaporized rich liquid and where, consequently, this vaporized rich liquid and the excess of non vaporized liquid are both evacuated through a lower lateral outlet box 9C of the exchanger 12C. Examples of such distributors are described in FIGS. 1 to 5 of the EP-A mentioned above. The diphasic mixture coming out of box 9C penetrates into a separator pot 30, and only the liquid phase is sent up to the distributor by means of pump 28.

FIG. 12 relates again to the case where the vaporized rich liquid is evacuated at the top of ducts 17D of the main exchanger 12D, via a lateral outlet box 9D corresponding to box 9B of FIG. 10.

In the variants of FIGS. 11 and 12, the exchanger 12C, 12D is surmounted by a mixed box 10C, 10D which is used for introducing the rich liquid which is sent up by means of the pump 28, to the inlet of the diphasic rich liquid carried by the duct 20 and to the evacuation of the vapor phase issued from this diphasic rich liquid. Duct 26 starts from this box 10C, 10D.

In the variants of FIGS. 11 and 12, it will be seen that the storage container 18B of FIG. 10 is removed, a bath of rich liquid with constant level being directly maintained at the top of the distributor 27C or 27.

It should be noted that in the arrangements with a streaming down of rich liquid, the vaporization, as illustrated in FIGS. 10 to 12, may extend along the entire height of section 12B or exchanger 12C, 13D, or it can extend only along its upper part as shown in FIGS. 1 to 7 and 9.

On the other hand, in each embodiment, the maintenance of refrigerating condition may be ensured by anyone of the known methods: installation of an expansion turbine on one of the ducts carrying a fluid under pressure (air, nitrogen or vaporized rich liquid), or direct injection of liquid nitrogen at an appropriate location:

at the inlet of nitrogen ducts 23 or at the exit of ducts 16, either by means of perforated tubes disposed in these ducts, or into box 10; or in the auxiliary storage holder 18 or 18B, which is more simple to carry out but does not permit the recovery of the nitrogen used to maintain refrigerating conditions; or still at the inlet of the supplementary nitrogen ducts provided for this purpose in the heat exchange line.

We claim:

1. Apparatus for the production of nitrogen including means for cooling compressed air from which water and carbon dioxide have been removed, rising means in which said air is progressively enriched into nitrogen, and condenser means coupled to an upper part of said rising means for cooling the nitrogen enriched air by vaporization, for forming a rich liquid and to produce a reflux; said rising means comprising first vertically disposed flat ducts disposed as a parallelepipedal plate-type heat exchanger and said condenser means comprising second vertically disposed flat ducts included in the same exchanger and disposed in heat exchange relationship with at least an upper part of the first ducts, a collection box for collecting rich liquid and coupled to the lower end of said first ducts, and a connection duct coupled to said collection box and having an expansion valve therein.

2. Apparatus according to claim 1, wherein said means for cooling compressed air comprises third flat ducts included in said heat exchanger and located above said first and second ducts, means for supplying said third ducts with inlet air, fourth ducts disposed in heat exchange relationship with said third ducts, said fourth ducts being located at the upper part of said first ducts and fifth ducts disposed in heat exchange relationship with said third ducts and being located at an upper part of the second ducts.

3. Apparatus according to claim 2, wherein said means for cooling compressed air is disposed above the first and second ducts.

4. Apparatus according to claim 1, wherein the condenser means includes an auxiliary storage container adjacent the heat exchanger for receiving rich liquid, said auxiliary storage container having a lower part connected to a lower part of the second ducts by said connection duct, and said auxiliary storage container having an upper part coupled to an upper part of the second ducts.

5. Apparatus according to claim 1, wherein the condenser means includes means to stream the rich liquid downwardly on surfaces of said second ducts to the bottom of said condenser means and a pump for pumping excess non-vaporized rich liquid from the bottom of said condenser means to the top of said condenser means.

6. Apparatus according to claim 5, wherein the condenser means includes an auxiliary storage container adjacent the heat exchanger and coupled to said connection duct to receive rich liquid therefrom and also coupled to said pump to receive rich liquid, and means for connecting said auxiliary storage container to said second ducts to return rich liquid thereto.

7. Apparatus according to claim 6, wherein said means for connecting said auxiliary storage container to said second ducts comprises a two step liquid distributor disposed at an upper end of said second ducts.

8. Apparatus according to claim 1, wherein the second ducts extend along the entire height of the first ducts.

9. Apparatus according to claim 1, wherein the second ducts extend only along a fraction of the height of the first ducts and further comprising spaces having an upper end in communication with said second ducts to provide a downward extension thereof and having a closed lower end.

10. Apparatus according to claim 1, wherein the second ducts extend only along a fraction of the height of the first ducts and further comprising spaces having an upper end in communication with said second ducts to provide a downward extension thereof and having a lower end which communicates with the first ducts.

* * * * *